United States Patent [19]

Peck

[11] Patent Number: 4,674,469

[45] Date of Patent: Jun. 23, 1987

[54] BOW STRING RELEASE

[75] Inventor: Paul L. Peck, Fond du Lac, Wis.

[73] Assignee: Tru Fire Corporation, North Fond du Lac, Wis.

[21] Appl. No.: 793,480

[22] Filed: Oct. 29, 1985

Related U.S. Application Data

[63] Continuation of Ser. No. 549,834, Nov. 9, 1983, abandoned.

[51] Int. Cl.[4] ..... F41C 19/00

[52] U.S. Cl. ..... 124/35 A; 124/32

[58] Field of Search ..... 124/35 A, 35 R, 25

[56] References Cited

U.S. PATENT DOCUMENTS

| | | | |
|---|---|---|---|
| 3,749,076 | 7/1973 | Suski et al. | 124/35 A |
| 3,857,379 | 12/1974 | Burghardt | 124/35 R |
| 3,948,243 | 4/1976 | Gazzara | 124/35 A |
| 3,998,202 | 12/1976 | Boyko et al. | 124/35 A |
| 4,083,348 | 4/1978 | Fletcher | 124/35 A |
| 4,257,386 | 3/1981 | Gassara | 124/35 A |
| 4,316,443 | 2/1982 | Giacomo | 124/35 A |
| 4,485,798 | 12/1984 | Hamm | 124/35 A |

*Primary Examiner*—Richard C. Pinkham
*Assistant Examiner*—Benjamin Layno
*Attorney, Agent, or Firm*—Bayard H. Michael

[57] ABSTRACT

The bow string release has a body having a notch receiving a string which is retained by a pivoted sear capturing the string. The body is connected to a handle. A thrust bearing is located between the body and the handle, allowing the body and the handle to rotate relative to one another. A spring loaded plunger latches the sear to retain the string until the plunger is moved back by a trigger pivotally connected to the handle. A spring is compressed between the plunger head and a seat which can be adjusted to alter the trigger pull force. The trigger stroke is adjusted by the screw in the trigger adjustably engaging the hole in the wall of the release handle. Another embodiment has provision for triggering the release of a spring loaded piston which strikes the plunger to release the sear. A further embodiment uses a small solenoid in the handle to move the plunger to release the sear.

14 Claims, 6 Drawing Figures

BOW STRING RELEASE

This is a continuation of co-pending application Ser. No. 549,834 filed on Nov. 9, 1983, and since abandoned.

FIELD OF THE INVENTION

This invention relates to devices for releasing a bow string. The devices are commonly called releases.

BACKGROUND OF THE INVENTION

Various bow string releases have incorporated means permitting rotation of the handle and trigger relative to the string retaining means. These units have suffered from basic structural weakness and/or poor rotation under load and/or difficulty in adjusting the trigger action. Archers are demanding releases which require very small force to actuate the release.

SUMMARY OF THE INVENTION

An object of this invention is to provide a release having a rotatable connection between a handle and a body having a string receiving notch and a sear pivoted for movement between a string retaining position and a release position. The sear is latched in its retaining position by a plunger which can be moved axially against the force of a biasing spring to release the sear to release the string. In one embodiment the trigger actuating the plunger is pivoted in the handle and is retained by the plunger passing through the trigger. The trigger pull force is adjustable. The trigger travel is adjustable. The body receiving the bow string is freely rotatable relative to the handle so the archer may position his hand for maximum comfort without twisting the string.

The invention provides for free rotation of the string holding body relative to the handle used to draw the bow. The trigger stroke and release force are adjustable with little interaction between the adjustments (as the trigger stroke is decreased there is a slight increase in the pull force).

Another form of the invention uses a spring loaded member to retract the plunger when the member is released from a latched position. The force required to release the member is very small.

The smallest release force if found in a third embodiment using a small solenoid to retract the plunger when a switch is actuated. That force is extremely small. A battery in the handle energizes the solenoid coil.

DETAILED DESCRIPTION OF THE DRAWINGS

Figure 3:
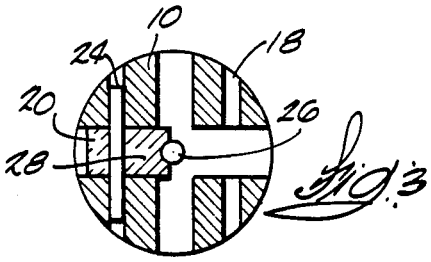
FIG. 3 is a section on line 3—3 in FIG. 2.
Figure 4:
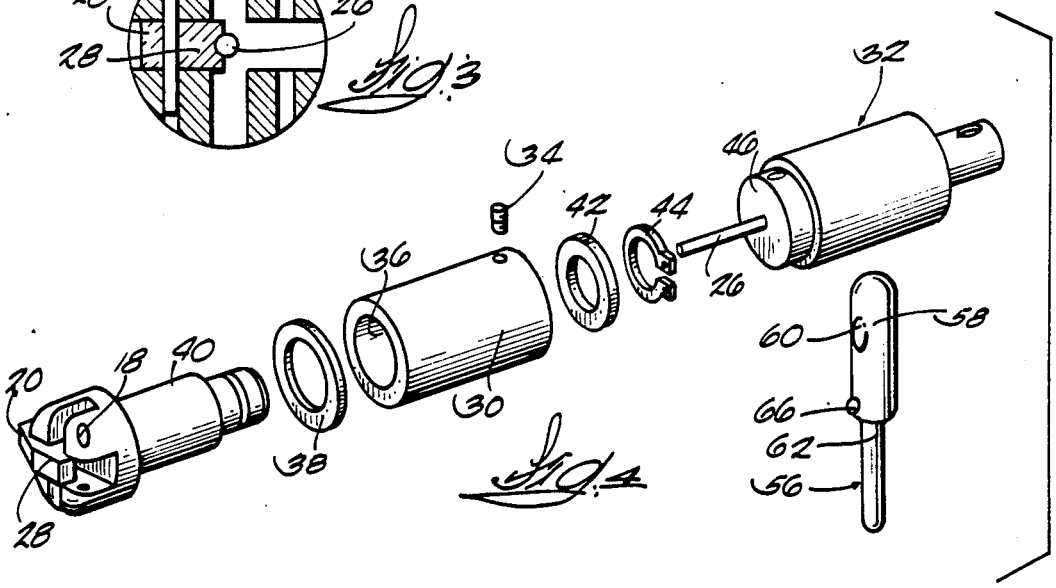
FIG. 4 is an exploded perspective view of the release.

The release has a body 10 rotatably connected to handle 12 and has a notch 14 receiving a bow string 16 or an intermediate loop (not shown) which can be tied through holes 18, passed around the bow string and retained in the notch. Such an arrangement is preferred by some archers. The bow string (or loop) is retained in the notch by the retaining finger portion 20 of sear 22 pivoted on pin 24 for rotational movement from the retaining position shown to a release position in which the finger swings away and opens the notch exit. The sear is held in the retaining position by the plunger 26 engaging the latch portion 28 of the sear to prevent rotation of the sear. As seen in FIG. 3, the tip of the latch is formed to straddle the plunger to ensure the sear is in alignment with the pivot to minimize friction.

Handle 12 includes sleeve 30 and a rear cylinder 32 fixed together by the hex head screw 34 threaded through the sleeve and projecting into a recess in the reduced forward end of the cylinder. The sleeve must be removed from the cylinder to assemble the sleeve and body. The body has a reduced diameter portion 36 projecting a substantial distance into the sleeve to give a good bearing surface for rotational movement of the body relative to the sleeve. The washer 38 between the body and sleeve serves to prevent entry of dirt. The rear end of the body has a further reduced diameter and the internal flange 40 on the sleeve projects inwardly so the rear face of flange 40 abuts low friction washer 42 which is retained on the body by "C" retainer 44 engaging a groove in the rear end of the body. A rearward force applied to the handle is transmitted from the sleeve 30 and flange 40 through the washer/bearing 42 to the retainer clamp 44 and to the body. The relatively large bearing surface ensures easy rotation of the body under load.

After the sleeve has been mounted on the body, the cylinder 32 can be connected to the sleeve by screw 34. The front of the cylinder has a wall 46 which has a central opening 48 to guide the plunger 26 as it reciprocates. The plunger has a head 50 which serves as a seat for compressed spring 52. The degree of compression and, therefore, the force of spring 52 is adjusted by seat 54 threaded into the reduced end of the cylinder. The spring force determines the force necessary to actuate (pull) the trigger 56.

The spring urges the plunger to the left to project into the notch to engage the sear latch. Movement of the plunger to the right to release the sear is controlled by trigger 56. The trigger has a rounded end 58 received in a socket on the inside of the cylinder to pivot about the socket. The plunger passes through a hole 60 in the trigger to keep the trigger in place. The actuating end 62 of the trigger extends through the aperture 64 in the cylinder. The plunger head 50 bears on the trigger to pivot it clockwise into engagement with the front edge of aperture 64 . . . more correctly, the trigger is biased to move the adjusting screw 66 into engagement with the front edge. Screw 66, therefore, determines the forward position of the trigger and, therefore, of the plunger. Thus, the screw 66 determines how much the plunger projects into engagement with the latch . . . and that determines how far the trigger is pulled to release the sear. The adjusting screw can be set for "hair trigger" action or for a substantial pull.

The trigger could extend through the handle and an aperture opposite aperture 64 with the trigger pivoting on an edge of the aperture.

The handle 12 is provided with holes 68 to permit a thong or lanyard to be tied to the handle to make a concho style grip or pull. Generally, the thong would pass through a tube and would be tied to a disc which prevents the hand from slipping off the tube. A solid finger grip could be mounted on the handle. The type of handle used is not of much importance with this construction. The important feature is the free and full rotation of the body without affecting the adjustments. Adjusting the pull force will not affect the pull stroke. Adjusting the stroke can have a slight (minor) effect on the force setting.

Figure 5:
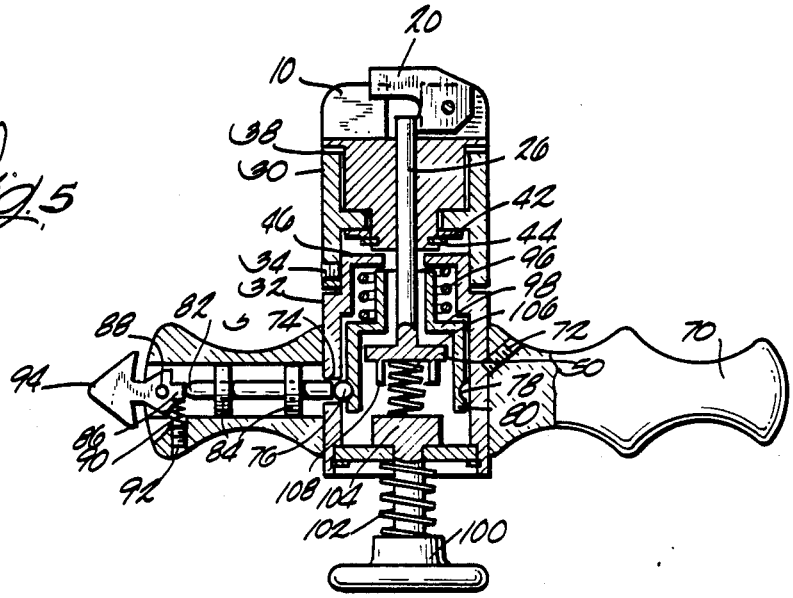
FIG. 5 is a section through another embodiment using a trigger to release a cocked mechanism.

FIG. 5 has a transverse handle 70 fitting over the rear cylinder 32 and fixed relative thereto by the set screw 72 which runs into a recess in the exterior surface of the cylinder 32. This fixes the transverse handle 70 precisely relative to the opening 74 in the side of the cylinder to receive ball 76 which, when the release is "cocked", is seated in the groove 78 in the lower end of the skirt of piston 80. The ball is held in that position by the pin 82 axially slidable in spaced bushings 84 and held to the right by the cam 86 pivoted on pin 88. The cam is urged counterclockwise by spring 90 compressed between the cam and the hex nut 92 which can be turned in or out to adjust the resistance to pivoting the cam.

When the archer pushes the actuating knob 94 forward, the notch in the cam will move into alignment with the pin 82 and let the pin move to the left as it is urged by the piston due to spring 96 compressed between the piston and the divider wall 46 pushing the piston down. As the pin 82 moves to the left, the ball 74 can move out of the groove and the piston is now free to move down under the bias of the spring 96 until the piston shoulder 98 impacts on the head 50 of the release plunger 26 and drives the plunger down to release the sear 20.

The release can be set to release with very little force on the trigger 94 while the spring force pulling the plunger from the sear can be considerable. After release, the plunger must be reset into engagement with the sear by pushing inwardly on knob 100 against the bias of spring 102 pushing the head 104 upwardly compressing spring 106 until the head 104 engages the depending cage 108 below the plunger head 50 pushing upwardly to engage head 50 with the piston shoulder 98. Continued motion pushes the piston up until the ball 76 can drop into the groove on the piston skirt. The ball is biased to drop into the hole since the face of spring 90 acting on the cam is transferred to the pin 82 to urge it to the right. As soon as the ball drops into the groove, the pin will be out of the way of the cam and the cam can reset and the release is ready for another operation. When knob 100 is released, spring 102 moves back to the position shown and the light spring 106 holds the plunger 26 in engagement with the sear.

Figure 1:
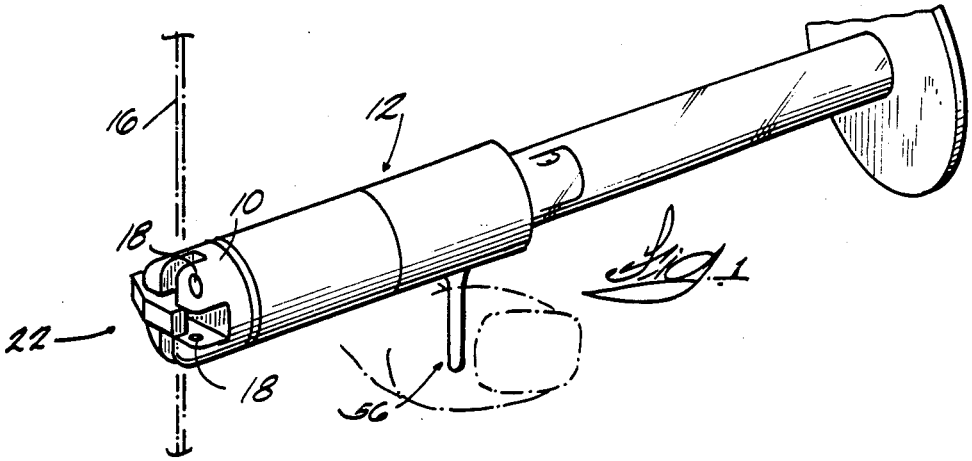
FIG. 1 is a partial perspective view of the release.
Figure 6:
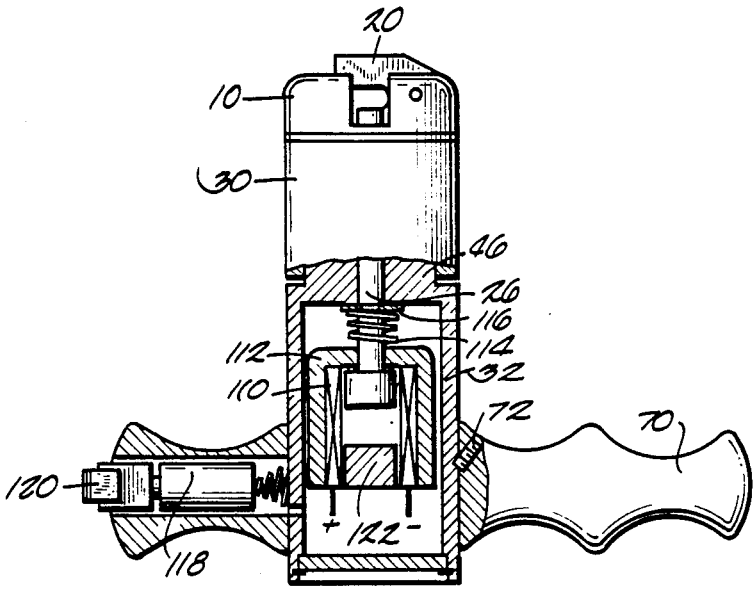
FIG. 6 is a section through an embodiment having a solenoid actuated release.

With the construction shown in FIG. 6, the cylindrical housing 32 is provided with a transverse handle 70 retained to the housing by set screw 72. The housing encloses a coil 110 carried by bracket 112 fixed in the cylinder 32 and receiving the lower end of the release plunger 26 which is biased upwardly by a spring 114 compressed between the bracket 112 and the C-type retainer 116 on the plunger 26. The plunger can engage a sear mounted directly on the reduced diameter portion 46 or the reduced diameter portion 46 can have a sleeve comparable to sleeve 30 in FIG. 1 connected thereto so as to accommodate a rotating body 10. The important point here, however, is that one side of the handle 70 is provided with a battery 118 wired in circuit with the coil 110 through switch 120. When the switch is closed, the coil will be energized and will pull the head of the plunger 26 into the coil until it hits the iron stop 122 and release the sear. With this arrangement the force required to trigger the release can be a fraction of an ounce. If desired, this will permit use of an integrated circuit providing for a variable time delay in closing the circuit to the coil after the switch is actutated. With such an arrangement, the archer is, in effect, protected against his own fault of prematurely triggering a release. Many archers tend to reach full draw and trip the release before they intend to or should release. With a variable timing integrated circuit, provision can be made for a time delay between triggering the release and actual release. This will make the archer settle down or at least afford the archer time to settle down and get a good shot off.

Figure 2:
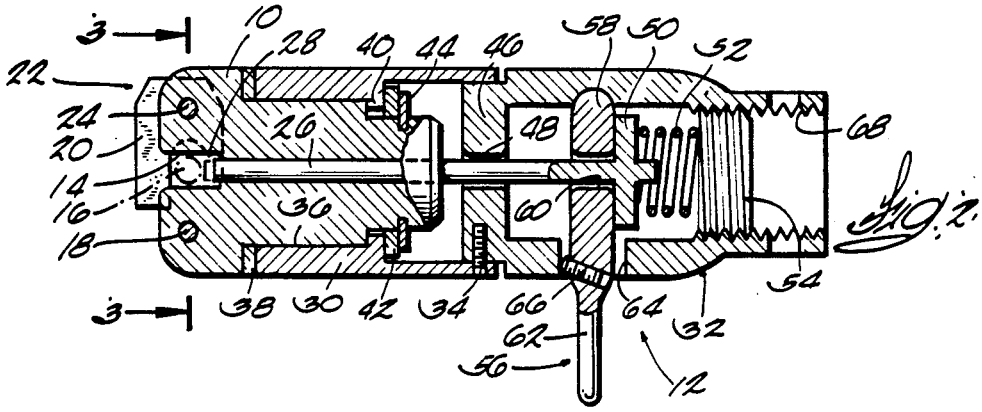
FIG. 2 is a vertical section through the release.

The generally U-shaped sear 22 has a long leg 20 which retains the bow string when the release is in retaining position with the plunger 26 engaging the short leg of the sear. After release of the string, the sear can be returned to the retaining position simply by pushing the release onto and against the taut bow string with the sear rotated about 45° from the position in FIG. 2. That 45° position locates the short leg to be engaged by the bow string and rotated to cock the release. Thus, the operation is a one-handed operation.

I claim:

1. A bow string release comprising, a body, a sear rotatably mounted on the body for movement between a string retaining position and a release position, a handle rotatably connected to the body, a thrust bearing between the body and the handle, a cylindrical plunger rotatably mounted in the body and handle for axial reciprocal motion between a first position in which an end of said plunger engages and retains the sear in said string retaining position and a second position in which it disengages the sear, spring means biasing the plunger to said first position, said plunger having a head remote from said plunger end which engages and retains the sear in said bow string retaining position, said spring means being compressed between said head and a seat threaded into said handle in axial alignment with said plunger, a trigger mounted in said handle and engaging said plunger between said head and said end of said plunger and operative to actuate said plunger to said second position, and said seat being adjustable to adjust the compression of said spring means and the force required to actuate said trigger, said body being a first part and said handle being a second part and said plunger being a third part, said first, second and third parts comprising a group of three parts lying on a common axis; each of said parts being rotatable with and with respect to each of the other of said parts of said group.

2. A bow string release according to claim 1 in which said trigger has one end pivoted on the interior of said handle and its other end projecting through an opening in the handle, movement of the plunger towards the first positon being limited by engagement of the trigger with the handle opening.

3. A bow string release according to claim 2 including means adjusting the contact of the trigger with the handle opening to thereby adjust the first position of the plunger and the plunger travel necessary to release the sear, the force required to actuate said trigger being unaffected by adjustment of the trigger contact with said handle opening.

4. A bow string release comprising, a body, a sear rotatably mounted on the body for movement between a string retaining position and a release position, a handle rotatably connected to the body, a thrust bearing between the body and the handle, a cylindrical plunger rotatably mounted in the body and handle for axial reciprocal motion between a first position in which it engages and retains the sear in said string retaining position and a second position in which it disengages the sear, spring means biasing the plunger to said first position, means for actuating the plunger to said second position, said plunger having a head remote from the plunger end which engages and retains the sear in said string retaining position, said actuating means acting on said head, said body being a first part and said handle being a second part and said plunger being a third part, said first, second and third parts comprising a group of three parts lying on a common axis; each of said parts being rotatable with and with respect to each of the other of said parts of said group.

5. A bow string release according to claim 4 in which the actuating means includes a piston biased to move said head to release the sear, means for latching said piston in an inoperative position, and means for disengaging said latching means.

6. A bow string release according to claim 5 in which said latching means includes a member radially engageable with said piston and means holding such member in engagement, trigger means including a manually operated cam for controlling engagement and disengagement of said member with said piston.

7. A bow string release according to claim 6 including means for manually moving said piston to a position to be re-engaged by said latching means.

8. A bow string release according to claim 4 in which the actuating means includes, a battery and electromagnetic means mounted in said handle and actuating said plunger, and a switch for completing the circuit from the battery to the electromagnetic means.

9. A bow string release according to claim 8 in which the electromagnetic means includes a solenoid coil into which the plunger is drawn when the coil is energized.

10. A bow string release comprising, a body, a sear rotatably mounted on the body for movement between a string retaining position and a release position, a handle rotatably connected to the body, a thrust bearing between the body and the handle, a plunger mounted in the body and handle for axial reciprocal motion between a first position in which it engages and retains the sear in said string retaining position and a second position in which it disengages the sear, spring means biasing the plunger to said first position, means for actuating the plunger to said second position, a cylindrical portion projecting rearwardly from said body, said handle including a sleeve fitting over said cylindrical portion and having an internal shoulder, an annular retainer fixed on said cylindrical portion rearwardly of said shoulder, a thrust washer between said shoulder and said retainer.

11. A bow string release according to claim 10 in which the handle includes a cylinder portion to which the sleeve is fixed axially and against rotation.

12. A bow string release according to claim 11 in which the cylinder portion of the handle has a rearwardly opening threaded aperture, an adjustable seat threaded into said threaded aperture, said spring means being compressed between the plunger and the seat.

13. A bow string release comprising, a body, a sear pivoted on said body for movement between a draw position and a release positon, said sear engaging a string in said draw position and being disengaged from the string in said release positon, a handle, a thurst bearing rotatably connecting the handle to the body to permit the body to rotate relative to the handle as the handle is drawn rearwardly, the draw force being transmitted through the thrust bearing to said body, a rotatable plunger mounted for reciprocal axial motion in the body and handle and having a head remote from the body, an adjustable seat in said handle, a spring compressed between said plunger head and said seat to adjustably bias the plunger to engage said sear to retain the sear in said draw position, an aperture in said handle, a trigger pivoted to said handle and projecting through said aperture, said trigger having a hole therethrough and said plunger passing through said hole, said trigger being engaged by said plunger head and moving said plunger head rearwardly when the trigger is actuated whereby the plunger is moved to release said sear, measn for adjusting the trigger movement necessary to move said plunger far enough to release said sear, said body being a first part and said handle being a second part and said plunger being a third part, said first, second and third parts comprising a group of three parts lying on a common axis; each of said parts being rotatable with and with respect to each of other of said parts of said group.

14. A bow string release comprising, a body, a strong receiving notch therein, a seat rotatably mounted on the body for movement between a string retaining position and a release position, said sear having a generally U-shape with a long leg which lies across said notch and retains said string in the notch, said sear having a short leg which projects into said notch when the sear is in said string retaining position, said legs being spaced apart far enough to receive a bow string between the legs, a handle rotatably connected to the body, a thrust bearing between the body and the handle, a cylindrical plunger rotatably mounted in the body and handle for axial reciprocal motion between a first position in which it engages said short leg of said sear and retains the sear in said string retaining position and a second position in which it disengages the short leg of the sear, spring means biasing the plunger to said first position, and means for actuating the plunger to said second position, engagement of a bow string with said short leg of said sear when the sear is in said release position being operative to force said short leg into positon to be engaged by said plunger, said body being a first part and said handle being a second part and said plunger being a third part, said first, second and third parts comprisinga group of three parts lying on a common axis; each of said parts being rotatable with and with respect to each of the other of said parts of said group.

* * * * *